United States Patent [19]

Majette

[11] Patent Number: 4,531,353

[45] Date of Patent: Jul. 30, 1985

[54] METHOD AND APPARATUS FOR SPINNING YARN UNDER CONSTANT TENSION

[76] Inventor: Joseph P. Majette, 4921 Sentinel Post Rd., Charlotte, N.C. 28211

[21] Appl. No.: 539,096

[22] Filed: Oct. 5, 1983

[51] Int. Cl.[3] ..... D01H 1/24; D01H 1/34

[52] U.S. Cl. ..... 57/94; 57/95; 57/98; 57/102; 57/264

[58] Field of Search ..... 57/93, 94, 95, 96, 98, 57/99, 102, 264

[56] References Cited

U.S. PATENT DOCUMENTS

| | | | |
|---|---|---|---|
| 1,189,045 | 6/1916 | Boles | 57/95 |
| 2,326,220 | 8/1943 | Henning et al. | 57/93 X |
| 3,788,606 | 1/1974 | Solter | 254/290 |
| 3,926,072 | 12/1975 | Richardson | 57/96 X |

FOREIGN PATENT DOCUMENTS

| | | | |
|---|---|---|---|
| 1202953 | 1/1960 | France | 57/93 |

*Primary Examiner*—Stuart S. Levy
*Assistant Examiner*—Joseph J. Hail, III
*Attorney, Agent, or Firm*—W. Thad Adams, III

[57] ABSTRACT

A spinning frame 10 is disclosed for processing a strand at a varying strand movement speed to produce a strand processed with uniform tension. The spinning frame includes a motor 21 and a planetary gear box 30 which operates as a differential having first and second speed input elements formed by the rotation of the gear box housing 31 and a variable speed shaft 36. Housing 31 rotates at a constant speed and shaft 36 at a variable speed determined by the speed of rotation of a motor 50 which is controlled by an input to a variable capacity pump 45. A computer 70 operates through a servo-valve 60 to vary the speed of cylinder 18 to produce a speed required to maintain uniform tension on the strand.

9 Claims, 8 Drawing Figures

METHOD AND APPARATUS FOR SPINNING YARN UNDER CONSTANT TENSION

TECHNICAL FIELD AND BACKGROUND OF THE INVENTION

This application relates to a method and apparatus which, according to the preferred embodiment disclosed herein, permits the spinning of yarn at a constant tension. Also according to the particular embodiment disclosed in this application, the method and apparatus relate to a cotton-system ring spinning frame of conventional design which is modified to operate according to the method and apparatus described. The application has use in many other fields, however, and may also be used, generally, to vary the speed rate change of a driven member having a high inertia load to accomodate finite power availability from a prime mover, such as a motor.

Conventional spinning frames operate at a constant spindle speed. Power is typically provided from a constant speed electric motor through a fixed gear train to the spinning frame cylinder, which typically runs the entire length of the spinning frame between the two opposing banks of spindles. Individual tapes or belts transfer power from the cylinder to spindles along the length of the spinning frame. As the spinning operation takes place, yarn roving is delivered from a supply package to the drafting zone of the spinning frame which generally comprises two or more sets of rollers which rotate at different speeds to elongate the roving as it passes from between one set of rollers to another. Twist is inserted into the yarn by passing the yarn under a traveler which rotates at high speed around a ring which surrounds the spindle on which the receiving bobbin is placed. In order to evenly distribute the newly twisted yarn along the length of the bobbin, the spinning frame ring rail reciprocates upwardly and downwardly according to a pre-determined pattern so that the yarn is placed on the bobbin in a desired manner. During the reciprocating motion of the ring, the tension on the yarn varies considerably. A relatively rapid variation in tension occurs as the ring rail reciprocates due to the constantly changing height of of the balloon created by the yarn being spun rapidly around the spindle by the traveler. Variation in the yarn package diameter caused by the winding pattern, i.e., filling wind, combination wind, etc., also causes a corresponding variation in yarn tension. Tension also varies considerably depending on a number of other well known variables.

Care must be taken to ensure that tension on the yarn during the entire spinning operation never exceeds the maximum tension which the yarn will withstand without breaking. This maximum tension must be pre-determined and the spindle speed of the spinning frame must be adjusted so that the maximum tension which the yarn will tolerate is never exceeded. In practice, the yarn is spun at a tension well below the maximum which can be applied to the yarn in order to provide a margin of error.

Care must also be taken on a conventional spinning frame to ensure that the yarn is spun above a minimum tension below which the yarn is weakened and not suitable for further processing. Since on conventional spinning frames the spindle is rotated at a constant speed, the tension constantly vaies between the upper and lower limits which have been previously established. This constant tension variation during the yarn spinning process is very unproductive. Tension variation on the yarn reveals itself in later processing, expecially in dyeing where variations in yarn tension can create variations in dye absorbability. As is well known, a variety of other defects can arise as a result of extreme variations in tension.

Aside from the decrease in yarn quality, overall productivity of yarn production is adversely affected, since under lower tension the yarn is not wound tightly on the bobbin. A looser wind on the bobbin also results in more frequent doffing. Of course, the machine is not running as long between doffs and more labor is required to doff the spinning frame more frequently. Loosely wound yarn is also subject to "sluffing off" during later processes.

In general, spinning yarn in the conventional manner with constantly increasing and decreasing tension results in a yarn having uneven cross-section—thus a lack of tensile strength uniformity. It has been determined that spinning yarn at a constant tension throughout the entire process results in a yarn having a more uniform cross-section and a tensile strength approximately 10% higher than equivalent yarn spun at a constant speed.

SUMMARY OF THE INVENTION

Therefore, it is an object of the invention to provide a method and apparatus for spinning yarn under constant tension.

It is another object of the present invention to provide a method and apparatus for varying the speed rate change of the driven member having a high inertia load to accomodate finite power availability from a prime mover.

It is yet another object of the present invention to provide a method and apparatus for utilizing the excess energy available on demand from a constant speed electric motor, such as is used to drive a conventional spinning frame spindle without exceeding the rated output of the motor.

It is yet another object of the present invention to provide a method and apparatus for varying the RPM of the spinning frame spindles in relation to the position of the ring relative to the spindles to continuously produce a uniform, optimum tension on the yarn during the entire spinning cycle.

It is still another object of the present invention to provide a method and apparatus which enables a planetary gear reducer to be used as a differential drive to provide a varying RPM input to the spinning frame spindles.

These and other objects and advantages of the present invention are achieved in the preferred embodiment of the method and apparatus below by providing a prime mover and a planetary gear box modified to act as a differential drive and having first and second speed input elements and a speed output element. The speed output element is connected to a strand processing machine such as a spinning frame for transmitting power thereto at a speed which is the sum of the first and second input elements.

Means are provided for transmitting power from the prime mover to the first speed input element at a constant speed. Means are also provided for transmitting power from the prime mover to the second speed input at a variable speed.

Data storage means are preferably provided for receiving and storing information correlating the speed of the strand processing machine at given stages during the strand processing with a constant tension on the strand. Sensing means are provided for sensing the stages of operation of the strand processing machine and generating an output signal responsive thereto. Logic means are also responsive to the output from the sensing means, the data stored in the data storage means and the power output of the prime mover to generate an output signal to the means for transmitting power from the prime mover to the second speed input of the planetary gear box differential at a speed which, when summed in the planetary gear box with the first speed input element, produces a speed at the speed output element which maintains a constant tension on the strand being processed.

According to a preferred embodiment of the invention, the planetary gear box differential comprises a planetary gear reducer having a sun gear and a plurality of planet gears positioned within a housing. The sun gear and the housing within which the sun gear is positioned are each mounted for rotation relative to the strand processing machine. The first speed element comprises means rotating the housing at a constant speed and the second speed input element comprises a shaft connected to said sun gear.

The means transmitting power from the prime mover to the second speed input comprises a variable capacity pump mechanically connected to the prime mover and a fixed capacity motor hydraulically connected to the pump and mechanically connected to the second speed input element.

According to the method of the present invention, the optimum tension at which a given yarn can be spun is first determined. Then the RPM for a given spinning frame required to produce the optimum tension on the yarn at each of a plurality of ring positions relative to the machine spindles is determined. The RPM of the spinning frame in relation to the position of the ring relative to the spindles is continuously varied to produce a uniform optimum tension on the yarn during the entire spinning cycle.

DESCRIPTION OF THE DRAWINGS

Some of the objects of the invention have been set forth above. Other objects and advantages of the invention will appear as the description of the invention proceeds, when taken in conjunction with the following drawings, in which.

DESCRIPTION OF THE PREFERRED EMBODIMENT

Figure 1:
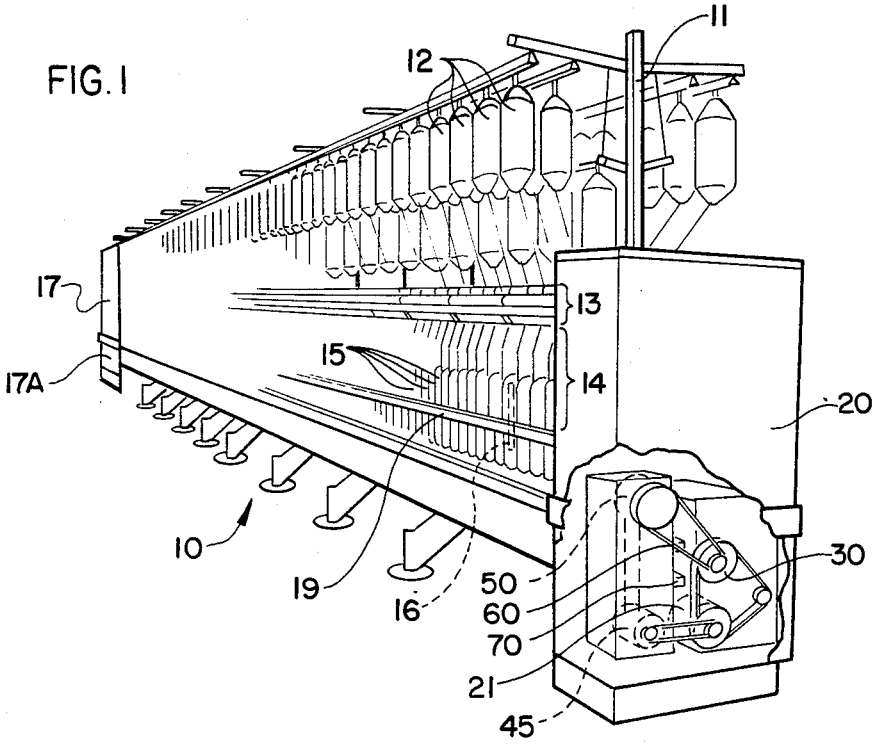
FIG. 1 is a perspective view of a yarn spinning frame with the apparatus according to this invention mounted thereon.

Referring now specifically to the drawings, a spinning frame according to the present invention is shown in FIG. 1 and designated broadly at reference numeral 10. Spinning frame 10 comprises a creel 11 from which is suspended supply packages 12 containing yarn roving to be spun. The roving is conveyed to a drafting zone 13 where it is elongated and then to a twisting zone 14 where a pre-determined amount of twist is placed into the yarn as the yarn is applied to a bobbin 15 which is positioned for rotation over a rotating spindle 16. Yarn is applied in a given pattern along the length of bobbin 15 by a reciprocating ring rail 19.

An individual spinning frame may contain from less than 200 to more than 400 spindles 16, equally divided between its opposite sides and driven from a single cylinder 18 (See FIG. 2) extending along the length of the frame 10. On one end of frame 10 is a head end cabinet 17 which contains the draft, twist and lay gearing, builder, windlass, and wind down mechanism, a hank clock and a ring rail sensor 17A. Sensor 17A will be explained in further detail below. On the opposite end of frame 10 is the foot end cabinet 20 within which is contained a prime mover comprising a constant speed electric motor 21. In conventional spinning frames, the electric motor 21 is used to rotate the spinning frame cylinder 18 at a constant speed.

Motor 21 on a given spinning frame may have a maximum rated output of, for example, 20 HP. The entire 20 HP may be necessary during startup since a substantial amount of inertia must be initially overcome. However, once motor 21 has reached its constant speed, it is using only a fraction of its total rated output, for example, 14 to 15 HP. The excess horsepower which is unused at its constant speed of rotation is utilized to provide variable speed rotation. Thus, a higher average RPM is obtained by using available excess power.

Figure 3:
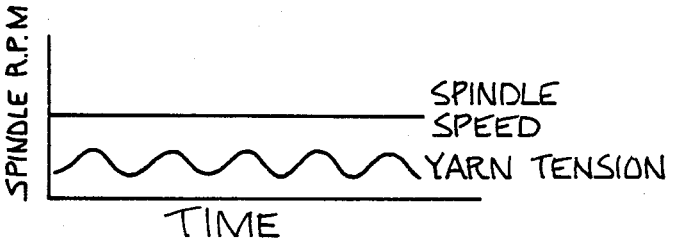
FIG. 3 (PRIOR ART)
FIG. 3 is a graph showing the relation between spindle speed and yarn tension on a prior art spinning frame.

Referring now to FIG. 3, a graph showing the prior art spinning frame process is shown. For a given period of time, the spindle RPM is maintained at a predetermined constant rate. Since the spinning variables are constantly changing, the yarn tension therefore varies accordingly, providing an uneven quality yarn.

Figure 4:
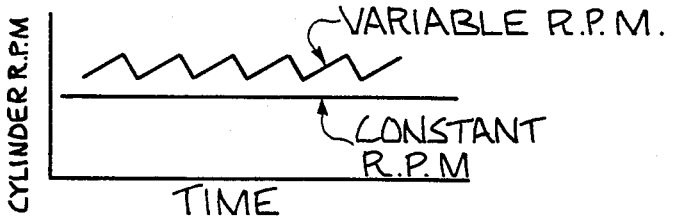
FIG. 4 is a graph which shows the constant RPM and variable RPM inputs of the apparatus according to the present invention.
Figure 5:
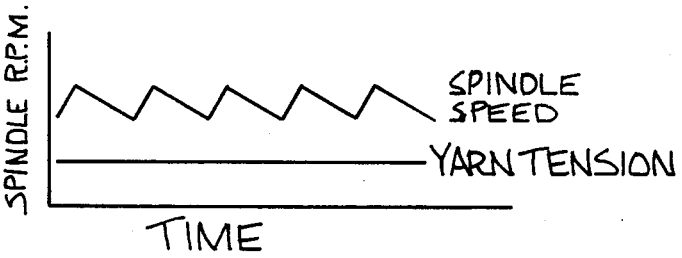
FIG. 5 is a graph showing the single speed output of the apparatus in relation to yarn tension.

FIG. 4 illustrates that a higher average RPM can be obtained by taking a constant RPM and summing it with a variable RPM. As is shown in FIG. 5, varying spindle speed in an appropriate manner over a given period of time results in an even yarn tension.

Figure 2:
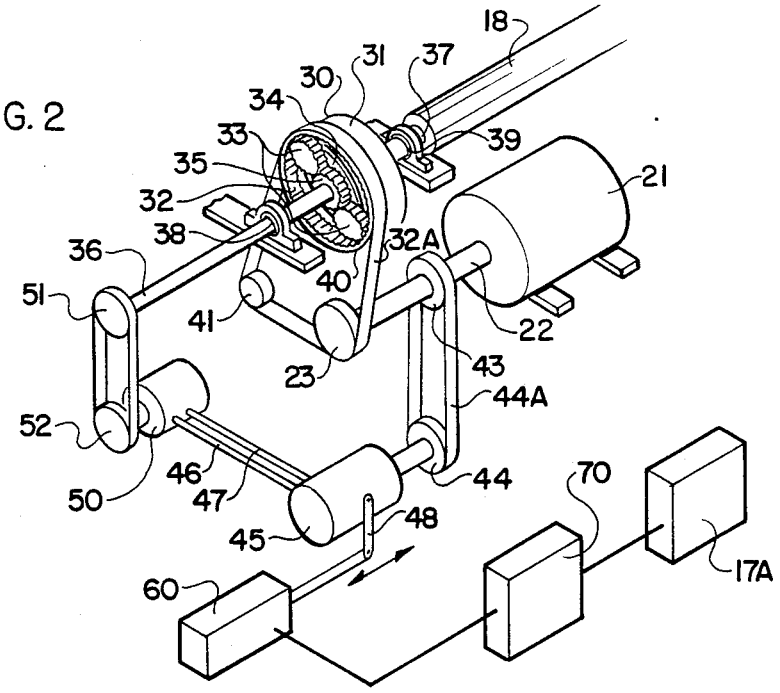
FIG. 2 is a schematic representation of the apparatus according to the invention, with parts rearranged and moved apart for better clarity and understanding of the relationship between the various parts.

The cooperation of these elements will be further explained with reference to FIG. 2, where these components have been visually rearranged to permit a more ready understanding of their operation.

The spinning frame cylinder 18 runs the length of the spinning frame between the two banks of rotating spindles 16 from the head end 17 to the foot end 20. Also positioned in cabinet 20 is a planetary gear box 30, a variable capacity hydrostatic pump 45, a fixed capacity hydrostatic motor 50, a servo-valve 60 and a computer 70.

Planetary gear box 30 comprises a housing 31 within which is mounted a gear annulus 32, planet gears 33 pinned to a planet carrier 34, a sun gear 35 rotatably mounted on an input shaft 36 and suitable and conventional reduction gears (not shown). An output shaft 37 is mounted for rotation on the planet carrier 34. Input shaft 36 and output shaft 37 are supported for rotation by bearing mounts 38 and 39, respectively. This permits housing 31 of planetary gear box 30 to freely rotate. Rotation of housing 31 is accomplished by affixing a large pulley 40 to one of its ends. A drive belt 23A passes around pulley 23, pulley 40 and an idler pulley 41 thereby rotating housing 31. Since motor 21 is rotating at a constant speed, the direct drive through shaft 22 and pulley 23 to pulley 40 rotates housing 31 at a constant speed and provides a constant speed input to cylinder 18.

A variable speed component is provided to cylinder 18 through the planetary gear box 30 from the input shaft 36. A pulley 43 is mounted for rotation on shaft 22 which is driven by motor 21. Pulley 43 drives pump 45 by means of a pulley 44 and a drive belt 44*a*. Pump 45 is hydraulically connected to motor 50 through hydraulic delivery and return conduits 46 and 47. Shaft 36 is rotated by motor 50 by means of pulleys 51 and 52 connected by a drive belt 53. Pump 45 and motor 50 together comprise a hydrostatic transmission. The direction of rotation and the speed of the output from motor 50 depend on the flow from pump 45. The speed at which pulley 52 turns is proportional to the position of a control lever 48 on pump 45. The direction of rotation of pulley 52 depends on the position of control lever 48 in relation to a pre-determined neutral position.

Rotation of shaft 36 at any given speed rotates sun gear 35. Differential rotation of sun gear 35 relative to housing 31 is additive to the RPM of shaft 37, divided by the gearing ratio of gear reducer 30. Therefore, the speed of rotation of cylinder 18 may be varied by varying the input speed of shaft 36 while maintaining the input speed to the housing 31 at a constant speed. However, in order to know when and at what rate the cylinder speed 18 should be increased or decreased, data must be available which permits the determination of the RPM required to produce yarn at a constant tension level.

There are numerous variables which affect yarn tension. These include relative humidity, balloon height, traveler weight, the full and empty diameter of the yarn bobbin, the coefficient of friction of the yarn through the traveler and the pigtail, and the traveler on the spinning ring. The yarn count, composition and ring diameter must also be known. These variables must be related to a particular cylinder RPM. Once an optimum tension is calculated, then an RPM is calculated which will provide the appropriate tension on the yarn at many different points throughout an entire doff, considering all of the necessary variables.

If the constant spindle RPM of the conventional spinning frame does not produce excessive ends down, that RPM can be designated as a minimum, or reference, RPM. Then, the speed of cylinder 18 is increased from and reduced back to that minimum RPM. Thus, the average spindle speed achieved according to the method and apparatus of this invention is always higher than the existing constant spindle speed, resulting in a corresponding increase in productivity.

Computer 70 includes a data storage bank into which the variables for the particular spinning frame 10 operating conditions are stored. The data stored in the data storage bank is used to compute a varying RPM which is necessary to provide a constant tension at as many as 1,000 points on a given RPM curve. Sensor 17A senses the movement of the ring rail 19. The sensor generates an output signal responsive to the location of the ring rail 19 relative to spindles 16 and also how many cycles the ring rail 19 has made since the last doff. Computer 70 therefore knows, at every instant, the bobbin diameter, the location of the ring rail 19, the part of the build ring rail 19 is now forming and how many more ring rail cycles are required to fill the bobbin 15 and shut down the frame 10 automatically. The computer correlates the information from the output signal of the sensor 17A and correlates it with the data stored in the data storage bank and generates an output signal to servo-valve 60. Servo-valve 60 moves control shaft 48 on pump 45 in the direction and to the degree necessary to provide the direction and speed of motor rotation to shaft 36 which, when summed with the constant rotation of housing 31, will provide the proper speed to cylinder 18.

Figure 6:
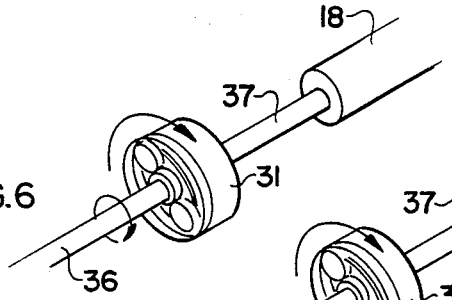
FIG. 6 is a simplified schematic view of the apparatus according to the present invention showing the variable RPM input additive to the constant RPM input.
Figure 7:
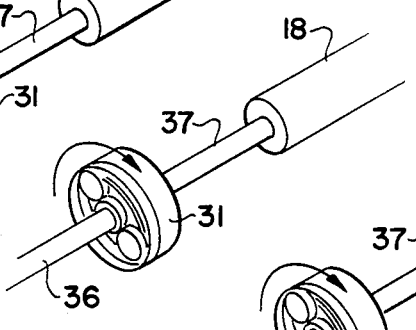
FIG. 7 is a view similar to that shown in FIG. 6 showing only constant speed RPM being applied to the spinning frame cylinder; and, FIG. 8 is a view similar to those shown in FIGS. 6 and 7, showing the variable RPM input subtractive from the constant RPM input.
Figure 8:
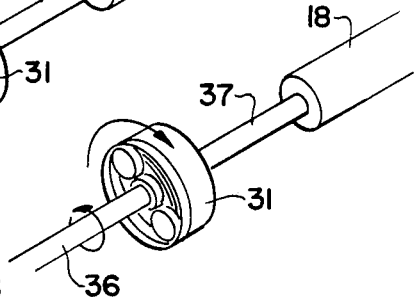

Referring now to FIGS. 6, 7 and 8, the production of the variable speed to cylinder 18 will be schematically explained. In each case, the housing 31 will be presumed to be spun in a clockwise direction by motor 21 operating on pulley 40 (see FIG. 2). Assume also that motor 21 is providing an output speed to shaft 37 of 1,500 RPM and that this RPM is not sufficient to create the necessary tension on the yarn. This fact is known to the computer 70 through data stored in its data storage bank. Output from computer 70 to servo-valve 60 moves control lever 48 on pump 45 in a direction into an extent appropriate to provide clockwise rotation of motor 50. This motion is transferred by shaft 36 through sun gear 35 to the planet carrier 34. Planet carrier 34, already rotating at the speed input to it by the rotation of housing 31 is rotated faster in the clockwise direction as is shown in FIG. 6.

If the speed being output from motor 21 through housing 31 is exactly sufficient to rotate cylinder 18 at the proper RPM to provide constant tension on the yarn, this condition is sensed by computer 70 and servo-valve 60 is commanded to maintain control lever 48 in the neutral position wherein motor 50 does not rotate. This is illustrated in FIG. 7.

If motor 21 is rotating housing 31 at a rate sufficient to cause excess tension on the yarn, this condition is corrected by the computer sending an instruction to servo-valve 60 to move control lever 48 in the direction and to the extent necessary to cause counterclockwise rotation of motor 50. This counterclockwise motion is transmitted through shaft 36 to sun gear 35 and the counterclockwise rotation is subtracted from the rotating speed of the planet carrier 34, causing the output speed of shaft 37 to cylinder 18 to be correspondingly reduced.

While a particular embodiment of the invention has been disclosed above, the invention lends itself to many other types of applications, for example in the operation of machine tools and conveyor drives. For example, consider the operation of long, heavily laden conveyor belts of the type used to convey coal from mines to transportation facilities. In many instances the power drives to these conveyor belts have sufficient power to move the conveyor while loaded but not to start a loaded conveyor from a stand still. Therefore, break downs which stop the conveyor sometimes require that the entire conveyor belt be unloaded of its cargo before it can be restarted with the drive. By using a variation of the invention according to this application, the load on the conveyor belt could be sensed and power directed to the variable speed drive means described above proportional to that load. With the conveyor at a standstill, a substantial percentage of the power of the drive might be directed through the variable speed drive means to reduce the input RPM to the conveyor and correspondingly increase the torque. As the initial inertia is overcome and the speed of the conveyor increases, more and more power can be directed straight to the conveyor from the drive means.

A method and apparatus for spinning yarn under uniform tension is described above. Various details of the invention may be changed without departing from its scope. Furthermore, the foregoing description of a preferred embodiment of the apparatus and method according to the present invention is provided for the purpose of illustration only and not for the purpose of limitation—the invention being defined by the claims.

I claim:

1. An apparatus for varying strand movement speed at given stages of operation of a textile strand processing machine having a prime mover to produce a strand processed with uniform tension, comprising:

(a) a planetary gear box having first and second speed input elements and a speed output element, said speed output element being connected to said strand processing machine for transmitting power thereto at a speed which is the sum of said first and second input elements;

(b) means for transmitting power from the prime mover to the first speed input element at a constant speed;

(c) means for transmitting power from the prime mover to the second speed input element at a variable speed;

(d) data storage means for receiving and storing information correlating the speed of the strand processing machine at given stages during the strand processing with a constant tension on the strand;

(e) sensing means for sensing the stages of operation of the strand processing machine and generating an output signal responsive thereto; and, (f) logic means responsive to the output signal from the sensing means, the data stored in the data storage means and the power output of the prime mover, and generating an output signal to the means for transmitting power from the prime mover to the second speed input of the planetary gear box at a speed which when summed in the planetary gear box with the first speed input element produces a speed at the speed output element which maintains a constant tension on the strand being processed.

2. An apparatus according to claim 1 wherein said planetary gear box comprises a planetary gear reducer having a sun gear and a plurality of planet gears positioned within a housing, said sun gear and said housing each being mounted for rotation relative to said strand processing machine, and wherein said first speed element comprises means rotating said housing at a constant speed and said second speed input element comprises a shaft connected to said sun gear.

3. An apparatus according to claim 1 wherein said means transmitting power from said prime mover to the second speed input comprises a variable capacity pump mechanically connected to said prime mover and a fixed capacity motor hydraulically connected to said pump and mechanically connected to said second speed input element.

4. An apparatus according to claim 1 wherein said textile strand processing machine comprises a ring-type yarn spinning frame.

5. An apparatus according to claim 4 wherein said data storage means receives and stores information correlating the speed of the spinning frame at given positions of the ring relative to the spindle necessary to apply a constant tension on the strand and said sensing means comprises means for sensing the position of the ring relative to the spindle during machine operation.

6. A spinning frame for processing a strand at a varying strand movement speed to produce a strand processed with uniform tension comprising:

(a) a prime mover for driving the spinning frame;

(b) a planetary gear box having first and second speed input elements and a speed output element, said speed output element being connected to the spinning frame for transmitting power thereto at a speed which is the sum of said first and second input elements;

(c) means for transmitting power from the prime mover to the first speed input element at a constant speed;

(d) means for transmitting power from the prime mover to the second speed input element at a variable speed;

(e) data storage means for receiving and storing information correlating the speed of the spinning frame at given stages during the spinning frame with a constant tension on the strand;

(f) sensing means for sensing the stages of operation of the spinning frame and generating an output signal responsive thereto; and, (g) logic means responsive to the output signal from the sensing means, the data stored in the data storage means and the power output of the prime mover, and generating an output signal to the means for transmitting power from the prime mover to the second speed input of the planetary gear box at a speed which when summed in the planetary gear box with the first speed input element produces a speed at the speed output element which maintains a constant tension on the strand being processed.

7. A spinning frame according to claim 6 wherein said planetary gear box comprises a planetary gear reducer having a sun gear and a plurality of planet gears positioned within a housing, said sun gear and said housing each being mounted for rotation relative to the spinning frame, and wherein said first speed element comprises means rotating said housing at a constant speed and said second speed input element comprises a shaft connected to said sun gear.

8. A spinning frame according to claim 6 wherein said means transmitting power from said prime mover to the second speed input comprises a variable capacity pump mechanically connected to said prime mover and a fixed capacity motor hydraulically connected to said pump and mechanically connected to said second speed input element.

9. A spinning frame according to claim 6 wherein said data storage means receives and stores information correlating the speed of the spinning frame at given positions of the ring relative to the spindle necessary to apply a constant tension on the strand and said sensing means comprises means for sensing the position of the ring relative to the spindle during machine operation.

* * * * *